United States Patent [19]

Smeal

[11] Patent Number: 4,834,215

[45] Date of Patent: May 30, 1989

[54] LEVELING AERIAL DEVICE-MOTOR VEHICLE ASSEMBLY

[76] Inventor: Donald L. Smeal, P.O. Box 146, Snyder, Nebr. 68664

[21] Appl. No.: 205,276

[22] Filed: Jun. 10, 1988

[51] Int. Cl.[4] ..... E06C 5/04

[52] U.S. Cl. ..... 182/66; 182/127; 182/17

[58] Field of Search ..... 182/64, 65, 66, 67, 182/68, 69, 127, 17; 91/41, 44

[56] References Cited

U.S. PATENT DOCUMENTS

| | | | |
|---|---|---|---|
| 198,576 | 12/1877 | D'Amore | 182/64 |
| 242,114 | 5/1881 | Crafts | 182/68 |
| 261,158 | 7/1882 | Johnson | 182/68 |
| 502,484 | 1/1893 | Dederick . | |
| 1,311,552 | 5/1919 | Christie . | |
| 1,531,982 | 3/1925 | Sago . | |
| 1,886,783 | 11/1932 | Bohlen | 182/65 |
| 1,925,517 | 5/1933 | Bohlen, Jr. . | |
| 1,979,041 | 9/1934 | Lundskow . | |
| 2,660,028 | 9/1953 | Geyer . | |
| 2,918,786 | 6/1959 | Geyer . | |
| 3,026,850 | 9/1962 | Clifton et al. . | |
| 3,075,503 | 10/1963 | Kimsey . | |
| 3,732,783 | 10/1973 | Emenaker . | |
| 3,785,249 | 7/1974 | Piroska . | |
| 3,979,999 | 7/1976 | Emenaker . | |

*Primary Examiner*—Reinaldo P. Machado
*Attorney, Agent, or Firm*—Cushman, Darby & Cushman

[57] ABSTRACT

An aerial device—motor vehicle fire fighting assembly in which a movable frame carrying an aerial device is connected between the fifth wheel of the tractor vehicle and the forward end of the fixed frame of the trailer vehicle. The connection between the movable and fixed frames is pivotal about a transverse horizontal axis under the control of hydraulic piston and cylinder units. The units effect relative pivotal movements between the movable and fixed frames and fixedly retain the same together into different positions of pivotal movement including (1) a transporting position wherein the movable frame constitutes a rigid forward extension of the fixed rearward frame enabling the entire trailer to turn and tilt with respect to the fifth wheel connection of the tractor during the power driven movement thereof and (2) an aerial device operating position wherein the movable frame extends horizontally in a longitudinal direction from the fifth wheel connection of the tractor to the fixed frame in a multiplicity of different positions of longitudinal inclination assumed by the tractor and the fixed frame by virtue of the longitudinally spaced vertical levels of engagement of the front wheels of the tractor with respect to the wheels of the fixed frame. Normally, retracted outrigger assemblies are extendible into an operative position of ground engagement to support the movable frame when in the aerial device operating position. An emergency load-bearing mechanism is provided to back up the piston and cylinder units in the event of hydraulic failure.

22 Claims, 7 Drawing Sheets

LEVELING AERIAL DEVICE-MOTOR VEHICLE ASSEMBLY

This invention relates to fire fighting equipment and, more particularly, to motorized fire fighting equipment of the type providing an aerial device.

The type of aerial device herein contemplated is an aerial ladder assembly or an aerial platform assembly whether for supporting personnel or for supporting a stream directing hose. In general, it can be stated that these devices are extendible and retractible usually between a transport position and an operative aerial position. Motorized fire fighting equipment of the type providing an aerial device has traditionally assumed basically two forms. First, the so-called aerial ladder fire truck which is a fixed chassis or frame vehicle having steerable front wheels and usually a tandem axle dual wheel set in the rear. Usually, the aerial device is mounted on the rear of the frame and is stored in a forwardly extending condition. A fixed frame truck of this type is usually provided with two forward and two rearward hydraulic rams operable to be vertically extended and retracted to level the frame when the aerial device is to be deployed and operated.

The second form is analogous to a tractor-trailer truck assembly. In this form, a motorized vehicle having steerable front wheels and a driven rear wheel is provided with a fifth wheel connection which is similar to the fifth wheel of a tractor except that it is considered to be a permanent connection rather than a detachable one. A trailer vehicle is connected at its forward end to the fifth wheel connection and is provided with rear wheels. In most instances, the rear wheels are steerable and the trailer vehicle is referred to as a tiller. The aerial device usually in the form of an aerial ladder assembly is mounted on the forward end of the tiller over the permanent fifth wheel connection and extends rearwardly in its storage position.

The advantage of the tiller type equipment over the fixed frame equipment is that the entire vehicle assembly can have a greater length since it is capable of articulation when being operated on the streets in getting to a fire. Moreover, this greater length provides greater stability at the fire location. However, there are severe limitations as to use at fire locations where relatively steep grades are presented. This is particularly troublesome in hilly cities, such as Pittsburgh, Pennsylvania and the like. In such cities, because of these limitations, fixed frame trucks are utilized. There exists a need for motorized fire fighting equipment which can achieve the length advantages of an articulated vehicle assembly and at the same time operate effectively in the steeper grades where fixed frame type trucks have heretofore been necessitated.

It is an object of the present invention to fulfill the need discussed above. In accordance with the principles of the present invention, this objective is accomplished by providing an aerial device—motor vehicle assembly comprising a power operated tractor vehicle having forward and rearward wheels and a rear fifth wheel connection and a trailer vehicle adapted to be connected to the fifth wheel connection and to be drawn by the power operated tractor vehicle. The trailer vehicle includes an elongated fixed rearward frame having wheels supporting the rearward portion thereof and a movable forward frame. The movable frame is connected with the fifth wheel connection of the power operated vehicle for enabling the movable frame to have a turning movement about an upright axis with respect to the power operated vehicle and a tilting movement about a transverse axis with respect to the power operated vehicle. A power operated extendible and retractible aerial device is mounted on the movable frame for swinging movement about an upright axis into a multiplicity of different operative positions including aerial positions imposing severe weight imbalances on the movable frame. The movable frame is connected with the fixed frame for pivotal movement about an axis transverse to the longitudinal extent of the fixed frame. A power operated mechanism is provided between the movable frame and the fixed frame for effecting relative pivotal movements between the movable and fixed frames and fixedly retaining the same together into different positions of pivotal movement including (1) a transporting position wherein the movable frame constitutes a rigid forward extension of the fixed rearward frame enabling the entire trailer vehicle to turn and tilt with respect to the fifth wheel connection of the tractor vehicle during the power driven movement thereof and (2) an aerial device operating position wherein the movable frame extends horizontally in a longitudinal direction from the fifth wheel connection of the tractor vehicle to the fixed frame in a multiplicity of different positions of longitudinal inclination assumed by the tractor vehicle and the fixed frame by virtue of the longitudinally spaced vertical levels of engagement of the front wheels of the tractor vehicle with respect to the wheels of the fixed frame. Normally retracted outrigger assemblies are provided which are extendible to support the movable frame when in its aerial operating position so as to extend horizontally in a transverse direction in a multiplicity of different positions of transverse inclination assumed by the tractor vehicle and the fixed frame by virtue of the transversely spaced vertical levels of engagement of the front wheels of the trailer vehicle and the wheels of the fixed frame.

The power operated mechanism provided between the movable frame and the fixed frame for effecting the movements which enables the connection provided by the vehicle assembly for the aerial ladder assembly to be leveled even where relatively steep grades are encountered must of necessity carry significantly heavy loads in operation. Hydraulic rams are preferably utilized since hydraulic fluid can be readily utilized to move the type of loads that may be presented. However, it is greatly preferred that provision be made for emergency bearing the heavy loads imposed in the event of a hydraulic fluid failure. In accordance with the principles of the present invention, an apparatus for moving a heavily loaded structure, such as the movable frame, with respect to another structure, such as the fixed frame comprises an extensible and retractible hydraulic piston and cylinder unit mounted with respect to the structures such that (1) extension of the unit causes the heavily loaded structure of move in one direction and (2) retraction of the unit causes the heavily loaded structure to move in an opposite direction. An elongated bolt is provided which has a longitudinal axis and is mounted in load bearing relation with respect to one of the structures for rotation of the bolt about the longitudinal axis. A nut is threadedly engaged on the bolt so as to move (1) in one direction of extension of the unit in response to the rotation of the bolt in a first direction and (2) in the opposite direction of retraction of the unit in response to the rotation of the bolt in a second direction.

A valve assembly is provided for controlling the flow of hydraulic fluid under pressure with respect to the hydraulic piston and cylinder unit so as to effect extension and retraction thereof and a first assembly is operatively connected with the bolt for selectively effecting rotational movement thereof about its longitudinal axis (1) in the first direction to thereby effect movement of the nut in the one direction and (2) in the second direction to thereby effect movement of the nut in the opposite direction. A second assembly serves to operatively connect the nut to the valve assembly so that (1) movement of the nut in the one direction causes the valve assembly to control the flow of hydraulic fluid under pressure with respect to the unit to effect extension thereof and (2) movement of the nut in the opposite direction causes the valve assembly to control the flow of hydraulic fluid under pressure with respect to the unit to effect retraction thereof. An emergency load bearing assembly is provided having a first portion mounted with respect to the structure other than the one structure with respect to which the bolt is mounted. A third assembly is provided for operatively connecting a second portion of the emergency load bearing assembly with respect to the nut in such a way that (1) hydraulic fluid under pressure within the unit retains the emergency load bearing assembly out of a load bearing relationship with respect to the nut and the other structure in any position of extension or retraction of the unit, and (2) unwanted loss of hydraulic fluid under pressure from the unit causes the emergency load bearing assembly to assume a load bearing relationship with respect to the nut and the other structure substantially in any position of extension or retraction the unit has been moved. The threaded engagement of the nut with the bolt is interlocked against self turning movement when the emergency load bearing assembly assumes the load bearing relationship.

Another object of the present invention is the provision of an aerial device-motor vehicle assembly of the type described which is simple in construction, effective in operation and economical to manufacture and maintain.

These and other objects of the present invention will become more apparent during the course of the following detailed description and appended claims.

The invention may best be understood with reference to the accompanying drawings wherein an illustrative embodiment is shown:

IN THE DRAWINGS

Figure 1:
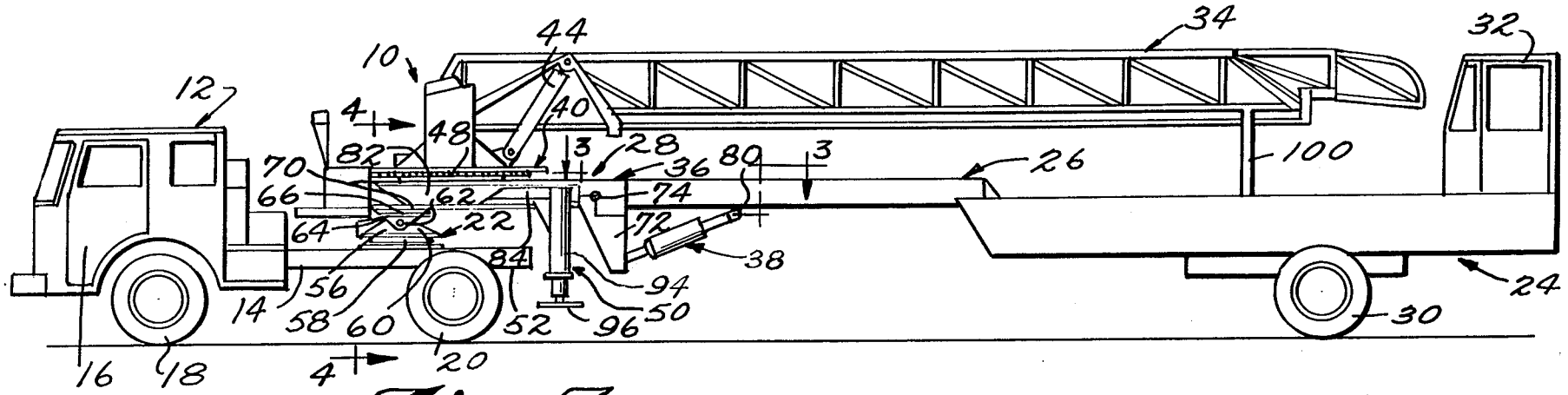
FIG. 1 is a side elevational view of an aerial ladder-motor vehicle assembly embodying the principles of the present invention.
Figure 7:
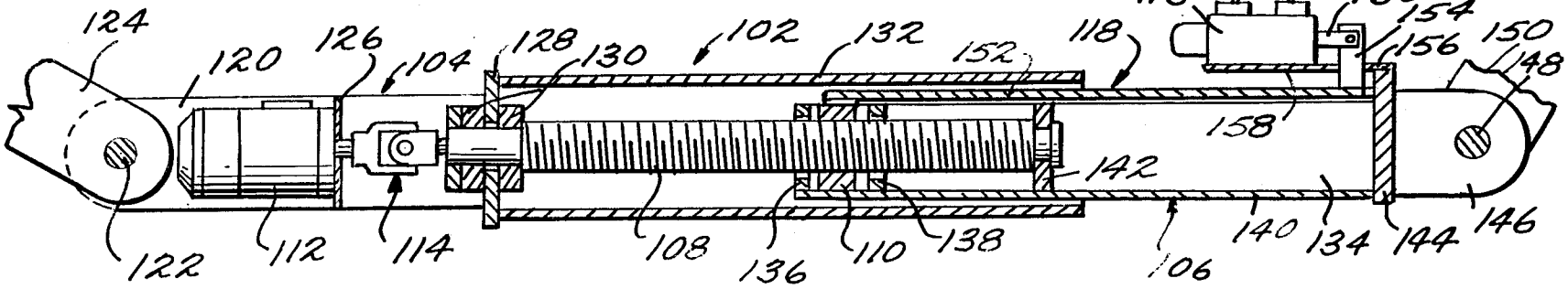
FIG. 7 is a sectional view taken along the line 7—7 of FIG. 3.
Figure 2:
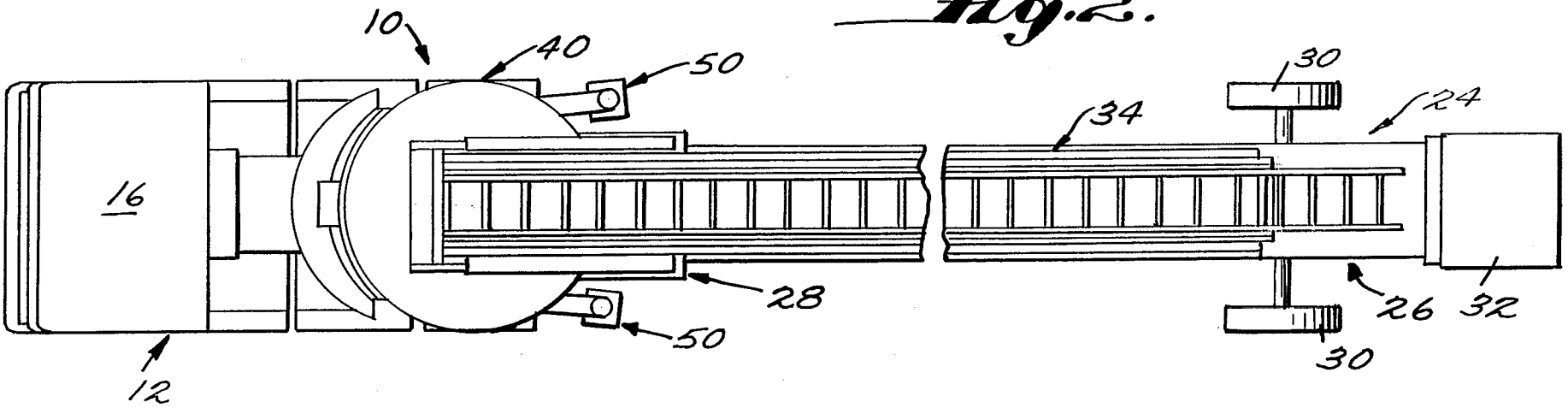
FIG. 2 is a top plan view of the apparatus shown in FIG. 1.

Referring now more particularly to the drawings, there is shown in FIGS. 1 and 2 an aerial device-motor vehicle assembly, generally indicated at 10, which embodies the principles of the present invention. As shown, the assembly 10 includes a power-operated tractor vehicle, generally indicated at 12. The tractor vehicle 12 is of conventional construction including all of the usual components embodied in tractor vehicles of the type adapted to pull trailers. For present purposes, it is sufficient to note that the power-operated tractor vehicle 12 includes a chassis or body 14 supporting an operator's cabin 16 containing all of the usual instrumentalities to enable the operator to operate the tractor vehicle 12. The chassis 14 is supported on forward steerable wheels 18 and rearward driving wheels 20. The chassis 14 also provides a fifth-wheel assmebly, generally indicated at 22, which is disposed rearwardly of the cabin.

The aerial device-motor vehicle assembly 10 further includes a trailer vehicle, generally indicated at 24, which in accordance with the principles of the present invention includes an elongated fixed rearward frame assembly, generally indicated at 26, and a movable relatively short forward frame assembly, generally indicated at 28.

The fixed rearward frame assembly 26 is supported at its rearward end by a rearward wheel assembly, generally indicated at 30. The wheel assembly 30 could be of the fixed non-steerable type in which case the trailer vehicle is of the pull-behind type, however, preferably, as shown, the wheel assembly 30 is of the steerable type and a cabin 32 is provided on the rear end of the rearward frame assembly 26 within which a steering attendant for the rear wheel assembly 30 is stationed when the vehicle assembly 10 is moved along the road. Thus, the trailer vehicle 24 is preferably of the tiller type which is well known in the art. In accordance with the usual practice, the tiller vehicle 24 is arranged to carry an extendible and retractible aerial device, which, as shown, is in the form of an aerial ladder assembly, generally indicated at 34. The aerial ladder assembly 34 is shown in FIG. 1 extending above the longitudinal extent of the tiller vehicle 24 in the position assumed when the tiller vehicle 24 is deployed for travel through the streets or for travel toward a position of operation of the aerial ladder assembly 34.

The present invention is particularly concerned with the various connections which are made with respect to the movable forward frame assembly 28. First, there is provided a pivotal connecting assembly, generally indicated at 36, between the rearward end of the movable frame assembly 28 and the forward end of the fixed elongated frame assembly 26 which provides for relative pivotal movement therebetween along a horizontal axis extending transverse to the longitudinal extent of the rearward frame assembly 26. The relative pivotal movement provided by the connecting assembly 28 is under the control of a power operated assembly in the form of a pair of hydraulic piston and cylinder units, generally indicated at 38, mounted between the movable frame assembly 28 and the fixed frame assembly 26 for effecting relative pivotal movements between the movable and fixed frame assemblies about the pivotal axis provided by the connecting assembly 36. Moreover, the hydraulic piston and cylinder units 38 serve to fixedly retain the two frame assemblies 26 and 28 together into different poitions of pivotal movement, one of which is a transport position, such as shown in FIG. 1, wherein the movable frame assembly 28 constitutes a rigid forward extension of the fixed rearward frame assembly 26. In this regard, it will be noted that the movable frame assembly 28 is connected with and supported on the fifth wheel assembly 22 of the tractor vehicle 12 so that when the movable frame assembly 28 is held as a rigid forward extension of the fixed rearward frame assembly 26, the entire trailer vehicle 24 is enabled to turn and tilt with respect to the fifth wheel assembly 22 of the tractor vehicle 12 during the power driven movement thereof.

Figure 4:
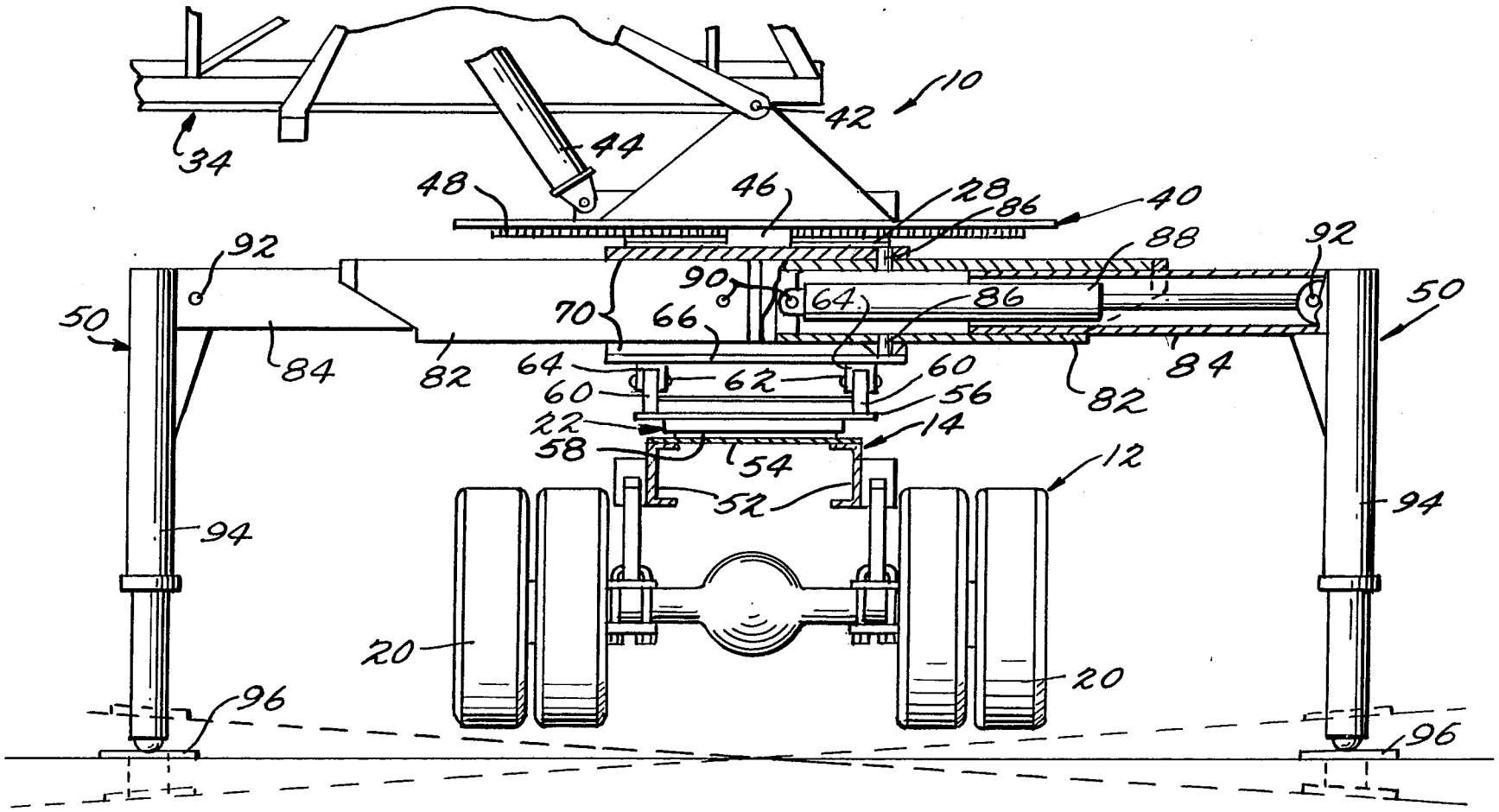
FIG. 4 is a vertical sectional view taken along the line 4—4 of FIG. 1 showing the aerial ladder assembly in a transversely extending position and the outrigger assemblies in their extended operative positions.
Figure 5:
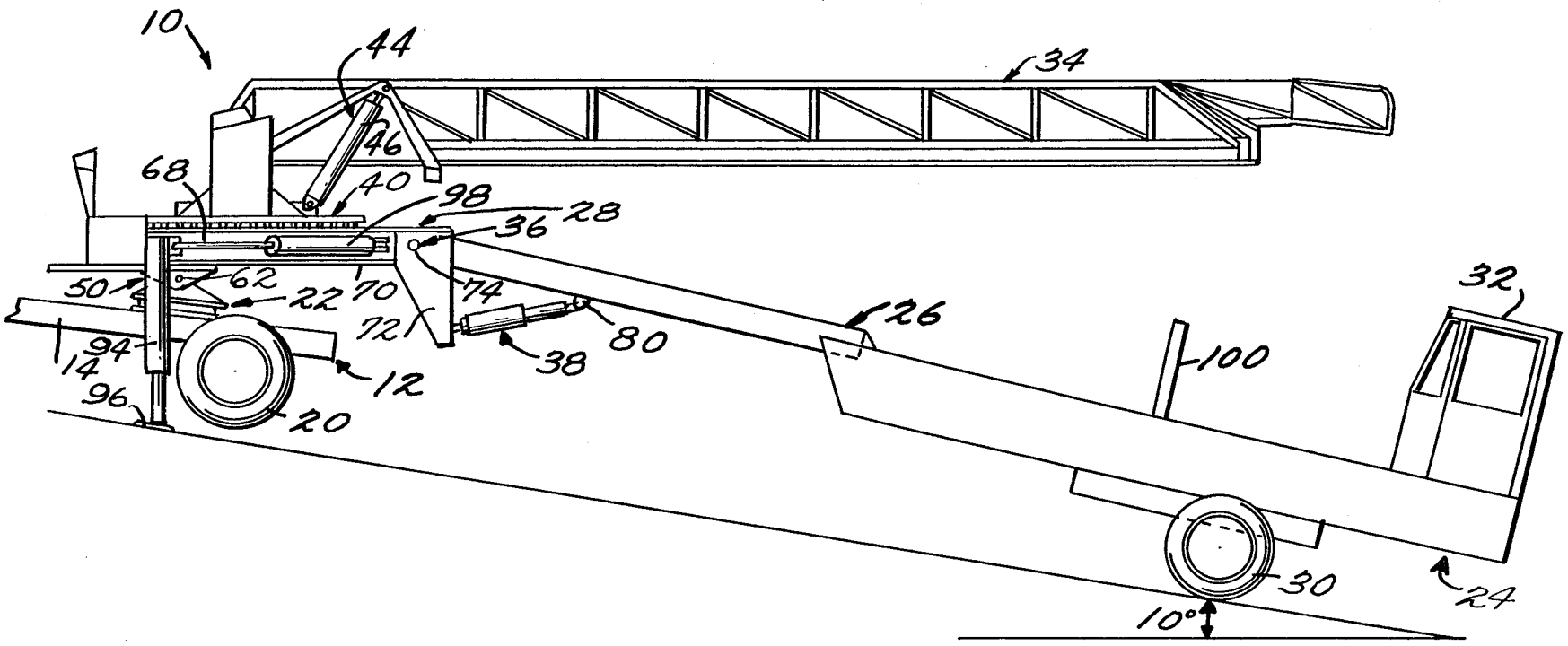
FIG. 5 is a fragmentary side elevational view of the assembly showing the position of the assembly when operating downhill.
Figure 6:
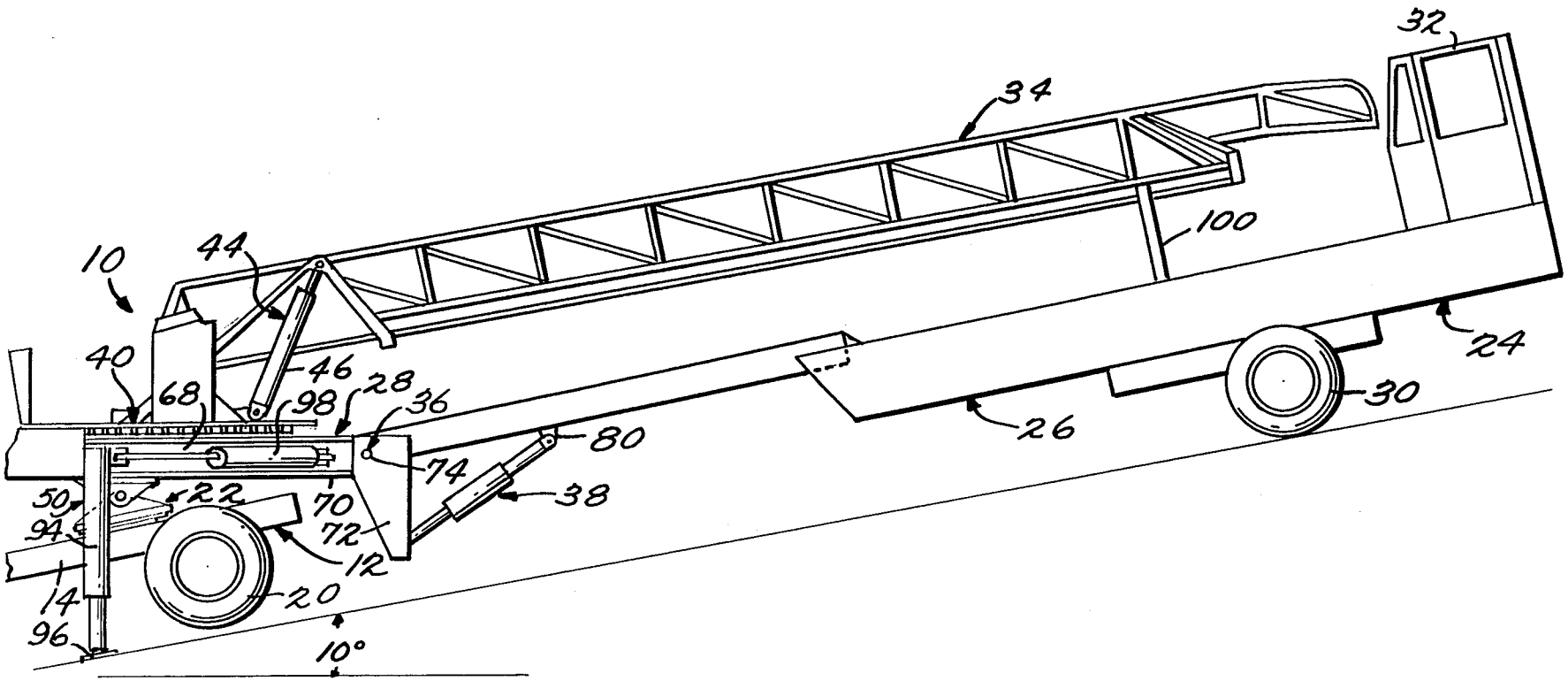
FIG. 6 is a view similar to FIG. 5 showing the position of the assembly when operating uphill.
Figure 8:
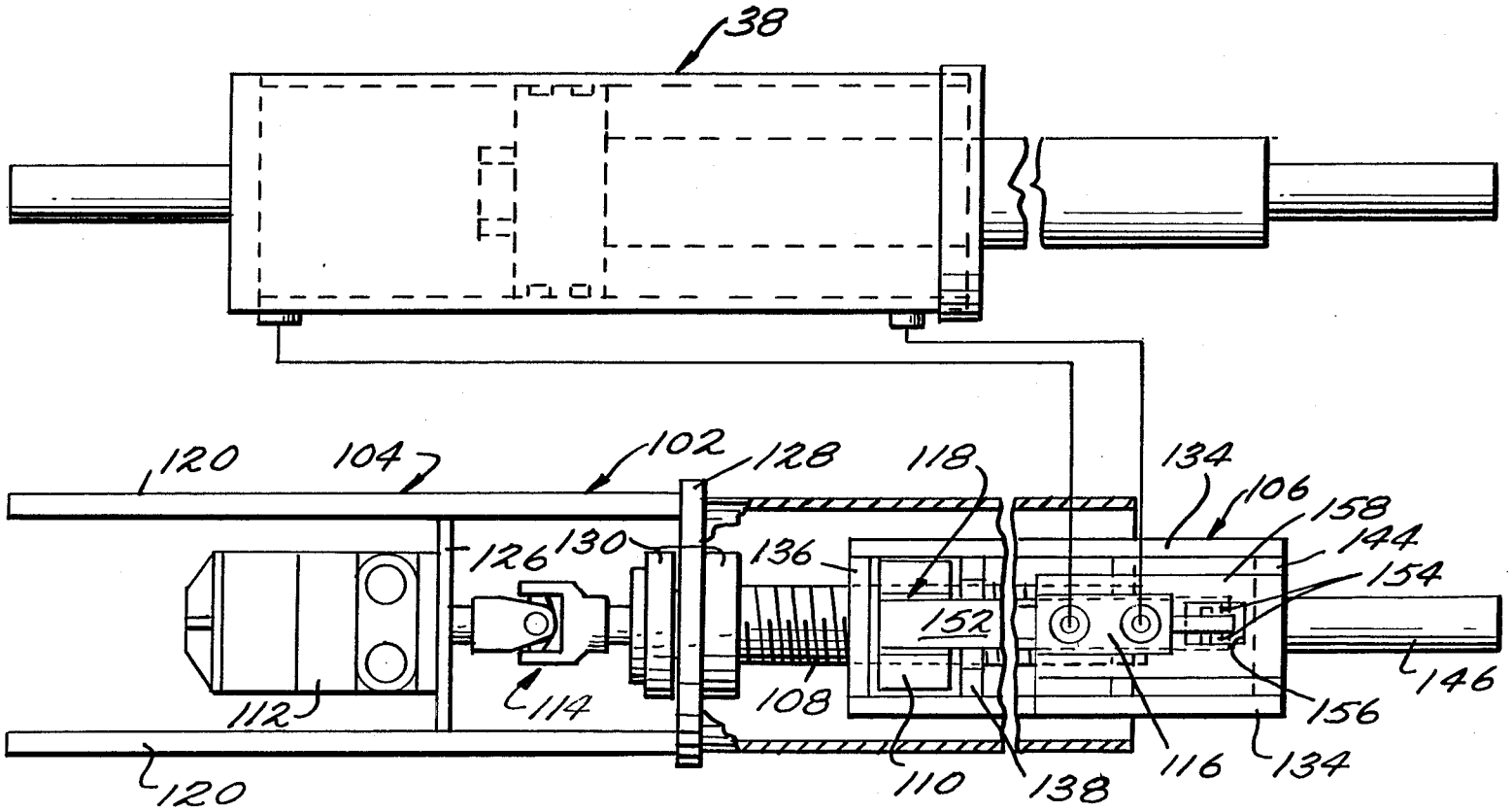
FIG. 8 is a top plan view, with parts broken away, of the emergency load-bearing assembly shown in FIG. 3, illustrating a hydraulic piston and cylinder unit in operative relation therewith.

Other positions of pivotal movement of the movable frame assembly 28 include a multiplicity of ladder-operating positions two of which are shown in FIGS. 5 and 6. In both instances, the rear wheel assembly 30 of the trailer vehicle 24 is fixed at a different vertical level with respect to the front wheels 18 of the tractor vehicle 12. In this regard, the movable frame assembly 28 carries a turntable structure, generally indicated at 40, which is mounted on the upper surface thereof for rotational movement about an upright normally vertically extending axis. The extendible aerial ladder assembly 34 has one end thereof pivotally mounted on the turnable, as indicated at 42 for pivotal movement about an axis transverse with respect to the longitudinal extent of the ladder assembly 34 so that the ladder can be moved between the transport position shown in FIG. 1 where, as previously indicated, the ladder assembly is supported by the rearward portion of the fixed frame assembly 26 and an operating position wherein the opposite end of the extendible ladder assembly has an aerial disposition. To effect this aerial disposition, hydraulic piston and cylinder units 44 are pivotally mounted between the turnable structure 40 and the ladder assembly 34 for effecting pivotal movement of the latter about the transverse axis 42 between its transport position and an operating position. Turning movements of the entire ladder assembly 34 with the turntable structure 40 about its upright axis is accomplished by a hydraulically operated unit 46 shown schematically in FIG. 4. The unit 46 may include a hydraulic motor driving a gear which meshes with a gear 48 fixed to the turntable structure 40. Since the ladder assembly itself is conventional, not all components of the hydraulic system embodied therein are shown. For example, the telescopically mounted ladder sections are extended and retracted by cable and pulley systems (not shown) actuated by hydraulic rams (not shown).

In addition to the above, the movable frame assembly 28 is also provided with an extendible and retractible outrigger assembly, generally indicated at 50, on each side thereof which is movable between a transport position alongside the associated side of the movable frame assembly 28 and an operative position extending laterally outwardly therefrom. The outrigger assemblies 50 when in their operative positions, together with the rear wheels 30 of the fixed frame assembly 26, assume the weight of the movable frame assembly 28 and everything connected therewith including the rearward end of the tractor vehicle 12 and the forward end of the fixed frame assembly 26 as well as the entire ladder assembly 34 and the turntable structure 40.

The tractor vehicle 12 is constructed in accordance with conventional practice for conventional tractor-tiller fire fighting equipment. The chassis 14 is of conventional configuration and, as shown in FIG. 4, includes two channeled beams 52 interconnected by a top plate 54. The fifth wheel assembly 22 likewise is of convention configuration and includes a rotary member 56 mounted on the top plate 54 by a suitable bearing 58 for rotational movement about an upright axis which normally extends vertically. The rotary member 56 includes a pair of transversely spaced upright lugs 60 which are suitably apertured to receive pivot pins 62 extending along a common axis through the apertures in the lugs and through appropriate bifurcated portions 64 of a platform member 66 suitably fixed beneath the movable frame assembly 28. The movable frame assembly 28, like the fixed frame assembly 26, may be of any conventional construction. The fixed frame assembly 26 is shown somewhat schematically in the drawings as being entirely of conventional construction. The movable frame assembly 28 includes a pair of side frame members 68 and upper and lower plate members 70 fixedly connected along the upper and lower edges of the side frame members, as by welding or the like. The plate members 70 extend beyond the sides of the side members 68 so as to provide a pair of extensions the forward ends of which receive the outrigger assemblies 50 therebetween.

The pivotal connecting assembly 36 between the frames 26 and 28 includes essentially a pair of transversely spaced parallel bracket plates 72 which are rigidly secured at their forward ends of the rearward ends of the side frame members 68 and adjacent portions of the plate members 70 forming the movable frame assembly 28. The bracket plates 72 are spaced transversely apart sufficiently to receive therebetween the forward end of the fixed frame structure 26. A pivot pin 74 extends through the two bracket plates 72 and the forward end of the fixed frame to accomplish the pivotal mounting.

Figure 3:
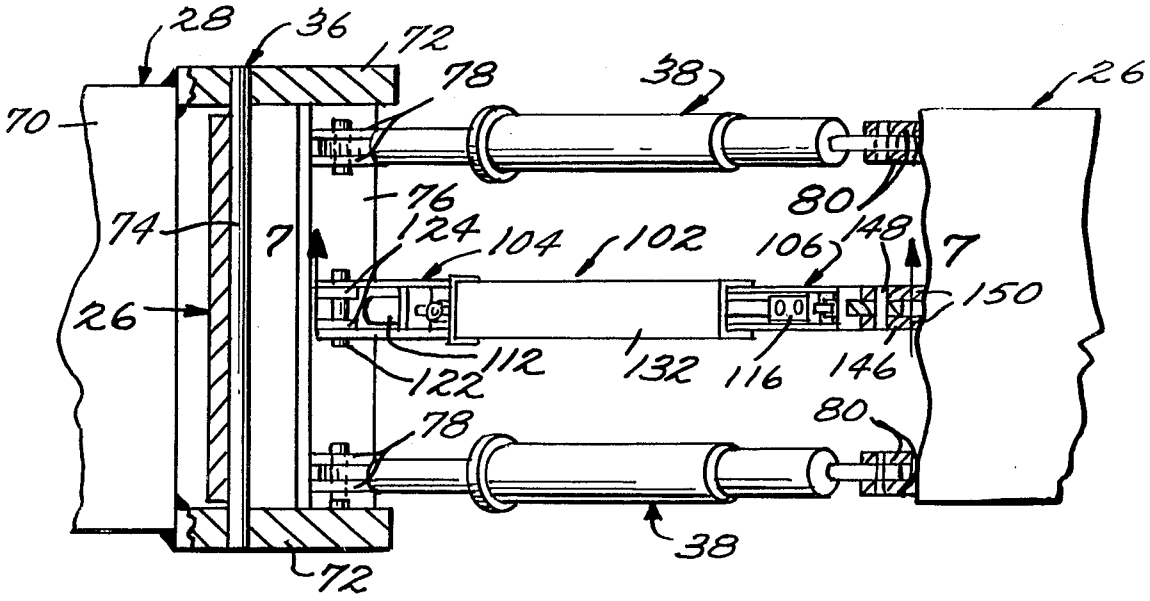
FIG. 3 is an enlarged fragmentary sectional view taken along the line 3—3 of FIG. 1.

As best shown in FIG. 3, extending between the lower ends of the bracket plates 72 and fixedly attached thereto, as by welding or the like, is a strengthening strut 76 of L-shaped cross section. Welded to the strut are appropriate upstanding lugs 78 for the reception of pivot pins which also extend through the corresponding ends of the piston and cylinder units 38. The opposite ends of the piston and cylinder units 38 are pivoted to suitable lugs 80 welded in depending relation to the fixed frame 26 at transversely spaced positions spaced rearwardly from the forward end thereof. In this way, extension and retraction of the piston and cylinder units 38 will effect the desired relative pivotal movement between the fixed frame assembly 26 and the movable frame assembly 28.

As best shown in FIGS. 4–6, each outrigger assembly 50 includes a pair of telescopically mounted horizontally extending arm members 82 and 84. The inner arm member 82 which is of hollow tubular configuration rectangular in cross-section is fitted between the associated side extensions of the plate members 70. As best shown in FIG. 4, a pair of vertically aligned pins 86 extend through the plate members 70 and the top and bottom walls of the inner arm so as to mount the same for pivotal movement about the upright axis provided by the pivot pins 86. The outer arm member 84 which is also of similar hollow construction but smaller than the inner arm member is telescopically mounted within the inner arm and extends outwardly therefrom. A hydraulic piston and cylinder unit 88 is mounted within both of the hollow telescoping arm members 82 and 84 and has its inner end connected, as indicated at 90, to the associated end of the inner arm and an opposite end connected, as indicated as 92, to the opposite end of the outer arm. Fixed to the outer end of the inner arm member 82 is the upper end of a vertically extending hydraulic piston and cylinder leg unit 94. The lower end of the leg unit 94 is formed with a swivel foot member 96 for engaging the ground.

As best shown in FIGS. 5 and 6, the structure of each outrigger assembly 50 thus far described is pivoted about the pivotal axis provided by the pins 86 by means of a hydraulic piston and cylinder unit 98 pivoted at one end to a suitable lug fixed to the rearward portion of the adjacent side member 68 and its other opposite end with a suitable lug fixed to the inner arm member 82 in a position spaced from the pivot pins 86 thereof. It can be seen that by retracting the hydraulic leg units 94, the ground-engaging foot members 96 will be raised to a storage position. In addition, by retracting the piston and cylinder units 88, the outer arm members 84 will be moved into fully telescoping relation within the inner arm members 82. Finally, by retracting the piston and cylinder units 98, entire assemblies 50 can be fully moved into a transport position alongside the side frame members 68, as is shown in FIG. 1.

As previously indicated, the transport position of the components of the aerial device-motor vehicle assembly 10 is shown in FIG. 1. In this position, the movable frame assembly 28 is disposed in a position extending horizontally from the forward end of the fixed frame assembly 26. The hydraulic piston and cylinder unit 38 serve to fixedly secure the movable frame assembly 28 in this position so that both of the frame assemblies constitute one rigid frame assembly which is capable of turning in a horizontal plane and pivoting or tilting in a vertical plane by virtue of the fifth wheel connection 22 with the tractor vehicle 12. It will also be noted that the aerial ladder assembly 34 is disposed in its transport position extending rearwardly from the turntable structure 40 so as to be supported in parallel relation above the fixed frame structure 26 as by the support 100. Finally, it will be noted that both outrigger assemblies 50 are disposed in their transport positions alongside the sides of the movable frame assembly 28. In the transport position, the entire assembly 10 is capable of moving through the city streets and over highways to reach a site where the assembly 10 is to be set up in operative position preparatory to a fire-fighting operation.

As previously indicated, the present invention is particularly suited to operation at operative sites where steep grades are encountered. FIGS. 5 and 6 illustrate two conditions of such a grade and the manner in which the assembly 10 of the present invention is deployed under the circumstances. After arriving at the site, the operator first actuates the piston and cylinder units 38 in an appropriate direction to effect a relative pivotal movement between the movable frame assembly 28 and the fixed frame assembly 26 to an extent such that the movable frame assembly 28 is moved into a horizontal position. As shown in FIG. 5, when the assembly 10 is oriented downhill with respect to the grade, hydraulic piston and cylinder units 46 must be simultaneously actuated to accommodate the movement between the frames. The relative movement of the frames is otherwise accommodated by the fifth wheel connection 22 and the support of the rear wheels 30 of the fixed frame assembly 26. This movement will orient the movable frame structure 28 in a horizontal position in a fore and aft direction. However, with the support of the movable frame still on the wheels 18, 20, and 30 of the assembly, the movable frame structure 28 may have an inclination in the transverse direction. Next, hydraulic piston and cylinder units 98 are actuated to move the outrigger assemblies 50 from their transport position into a position where the telescoping arm members 82 and 84 are disposed in an outwardly extending relation such as shown in FIGS. 4–6. Next, hydraulic piston and cylinder units 88 are actuated to extend the same and move the outer arm members 84 outwardly. Finally, the piston and cylinder leg units 96 are actuated to extend the foot members 98 down into ground engagement. Continued extension of the piston and cylinder leg units 96 will have the effect of moving the rear wheels 20 of the tractor vehicle 12 out of ground-engaging relation and transferring the lateral stability and load of the movable frame assembly 28 to the outrigger assemblies 50.

It will be understood that the outrigger assemblies 50 are actuated so as to effect the movement of the movable frame assembly 28 into a transversely extending horizontal position. It will be noted that any lateral tilting movement which is imparted to the movable frame assembly 28 during this deployment will be reflected in a comparable tilting movement of the chassis of the tractor vehicle 12 and the fixed frame assembly 26. The tilting movement of the tractor vehicle 12 is accommodated by the springs associated with the ground-engaging front wheels 18. The tilting movement of the fixed frame assembly is accommodated by the springs of ground-engaging rear wheels 30 of the trailer vehicle 24.

It is noted that the positions the foot members 96 engage the ground is slightly longitudinally forwardly of the horizontal pivot pins 62 of the fifth wheel assembly 22 which provide a transverse axis which intersects with the upright axis thereof. The upright axis of the turnable structure 40, which intersects the axis provided by the ladder pivot 42, is spaced rearwardly from the fifth wheel transverse axis 62 and forwardly of the transverse pivotal axis 74 of the frames. The fifth wheel assembly 22 serves to support the rear end portion of the tractor vehicle 12 including rear wheels 20 out of ground engagement with the front wheels 18 in ground engagement. The rearward portion of the movable frame structure 28 is supported rigidly through the hydraulic piston and cylinder units 38 and by the fixed frame assembly 26 to the ground through the rear wheels 30. In this position, the operator can then operate the controls to move the turntable structure 40 about its now vertical axis which carries with it the aerial ladder assembly 34. Actuation of the piston and cylinder units 46 of the aerial ladder assembly 34 serve to raise the ladder assembly into a desired aerial operative position and it will also be understood that the ladder assembly is capable of being power operated to extend the telescopically mounted sections as desired. It will be noted that, in many of the aerial operative positions of the aerial ladder assembly, the aerial ladder assembly 34 imposes severe weight imbalances on the movable frame assembly 28. In many positions of adjustment, these imbalances are transmitted between the movable frame structure 28 and the fixed frame structure 26 through the hydraulic piston and cylinder units 38. In the event that a hydraulic failure should occur, the geometry is such that a substantial relative movement between the two frame assemblies could take place resulting in a collapse or failure of the mount. In order to limit the extent of relative movement between the two frames which can take place in the event of a hydraulic failure in the units 38, there is provided an emergency loadbearing mechanism, generally indicated at 102, as is best shown in FIG. 3.

Referring now more particularly to FIGS. 3 and 7–9 there is shown therein an emergency load-bearing mechanism 102 which embodies the principles of the present invention. As shown, the emergency load-bearing mechanism 102 includes essentially a pair of emergency load-bearing rigid structures, generally indicated at 104 and 106, an elongated bolt or screw 108 rotatably supported on one of the structures, a nut 110 threadedly engaged on the bolt 108, a hydraulic motor 112 drivingly connected with the bolt 108 through a motion-transmitting assembly, generally indicated at 114, a metering valve mechanism 116 and a motion-transmitting assembly, generally indicated at 118, between the nut 110 and the metering valve mechanism 116.

As shown, the first rigid structure 104 is in the form of a pair of elongated parallel bars 120, one end portion of each of which is apertured to received a pivot pin 122 therethrough which also extends through lugs 124 fixed to the L-shaped support strut 76 fixed between the mounting bracket plates 72 of the movable frame assembly 28, as is shown in FIG. 3. The bars 120 have a rigid connecting plate 126 fixed to and extending between the central portions thereof to which the hydraulic motor 112 is fixedly attached. The plate 126 is centrally apertured to enable the output shaft of the hydraulic motor 116 to extend therethrough for connection with the motion-transmitting mechanism 114, which, in turn, is drivingly connected to one end of the bolt 108. The end of the bolt 108 is rotatably supported in a cross bar 128 fixedly attached to the adjacent ends of the bars 120, as by welding or the like. As shown, the rotatable support is provided with a double-acting thrust bearing 30 mounted on opposite sides of the cross bar 128 suitably fixed on the bolt 108. The first rigid structure 104 also includes a tubular member 132 of rectangular cross-sectional configuration fixed at one end, as by welding or the like, to the opposite face of the cross bar 128 so as to extend longitudinally therefrom.

The second rigid structure 106 includes a pair of elongated parallel bars 134 which are interconnected at one end with a cross bar 136 having a central aperture extending therethrough of a size to permit the bolt to extend therethrough with clearance. The apertured cross bar 136 is disposed in closely spaced relation on one side of the nut 110 threaded on the bolt 108. Mounted in closely spaced relation on the opposite side of the nut 110 is a second cross bar 138 which likewise is rigidly secured between the bars 134, as by welding or the like. The cross bar 138 is also centrally apertured so as to receive the bolt 108 therethrough with clearance. Preferably, the bars 134 are reinforced along their length by an interconnecting plate 140 which is welded along one of the edges thereof. The portion of the rigid structure 106 defined by the bars 134 and plate is of U-shaped cross-sectional configuration forming a trough within which a guide plate 142 is slidably mounted. Guide plate 142 rotatably supports the adjacent free end of the bolt 108.

The ends of the bars 134 opposite from the cross bars 136 and 138 are rigidly attached, as by welding or the like, to an end plate 144 which is also fixed to the adjacent end of the reinforcing plate 140. The rigid structure 106 also includes a lug 146 fixed to and extending from the end plate 144. The lug is apertured to receive a pivot pin 148 which serves to pivotally mount the rigid structure 106 to lugs 150 fixed, as by welding or the like, beneath the fixed frame assembly 26 at a position between the mounting lugs 80 for the hydraulic piston and cylinder units 38 (see FIG. 3).

The motion-transmitting mechanism 118 includes an elongated strap member 152 which is suitably welded at one end to the periphery of the nut 110. The opposite end of the elongated strap member 152 is formed with a bifurcated portion 154 which extends transversely therefrom. The bifurcated portion 154 extends through an opening 156 formed in a mounting plate 158 fixed at one end to the end plate 144. The mounting plate 158 serves to fixedly support the metering valve mechanism 116 which includes an actuating rod 160 connected with the bifurcated portion 154 of the strap member 152 as by a connecting pin or the like.

Figure 9:
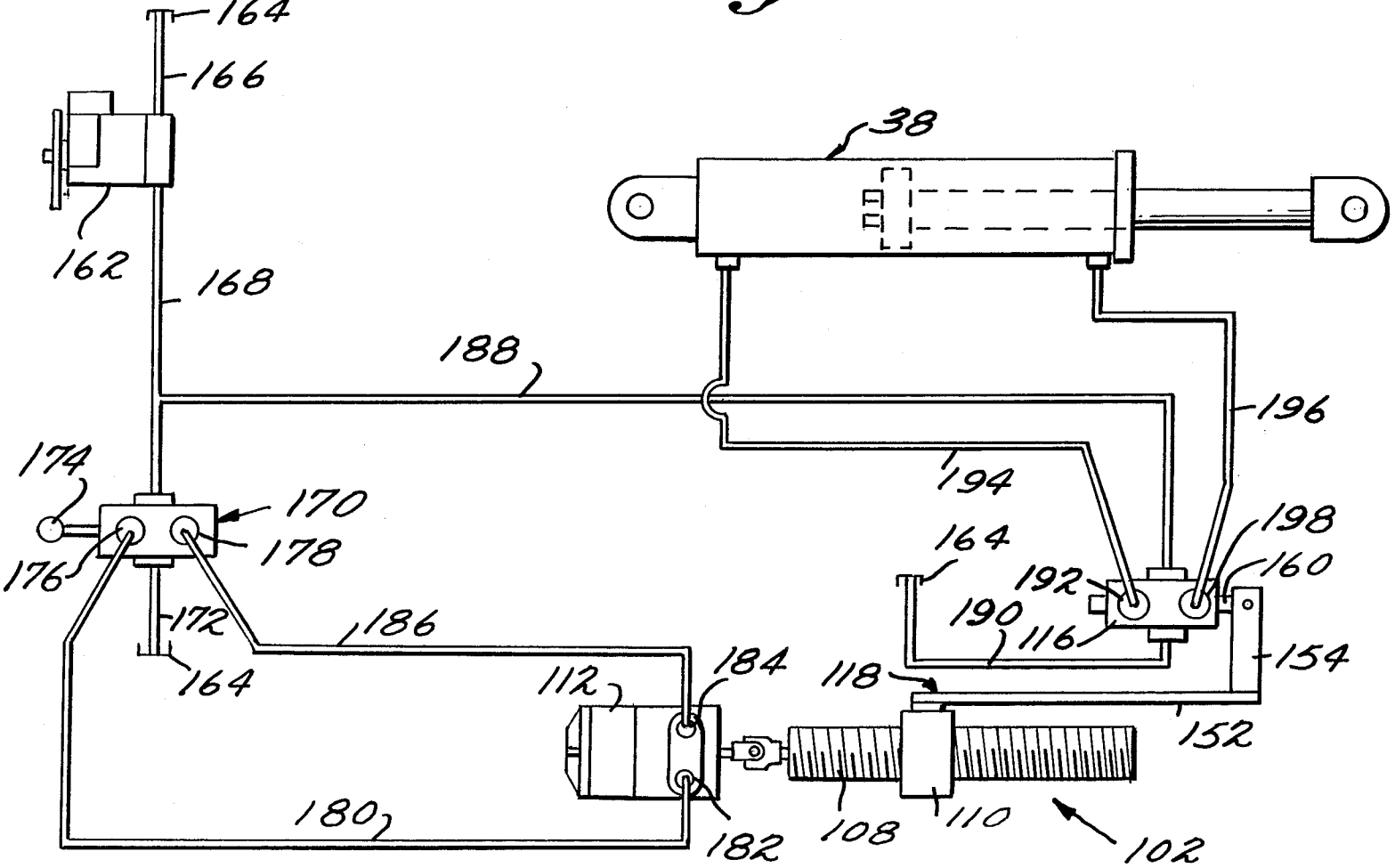
FIG. 9 is a schematic hydraulic flow diagram of the emergency load-bearing assembly utilized with the hydraulic piston and cylinder unit in accordance with the principles of the present invention.

Referring now more particularly to FIG. 9, there is shown therein a schematic diagram of a hydraulic system for coordinating the operation of the emergency load-bearing mechanism 102 with the operation of the piston and cylinder units 38. As shown in FIG. 9, there is included a main hydraulic pump 162 which draws hydraulic fluid from a sump 164 through an inlet line 166 and feeds hydraulic fluid under pressure to an outlet line 168. The outlet line 168 is connected with a manual control valve mechanism, generally indicated at 170. In its normal position, the manual control valve mechanism 170 enables high pressure fluid in the line 168 to pass through the valve mechanism back to the sump 164 by a line 172. When a control lever 174 of the manual control valve mechanism 170 is moved in one direction, the inlet line 168 containing the hydraulic fluid under pressure is connected with a first inlet/outlet 176 and the sump line 172 is connected with a second inlet/outlet 178. The first inlet/outlet 176 is connected as by a line 180 with one inlet/outlet 182 of the reversible hydraulic motor 112 and an opposite inlet/outlet 184 thereof is connected by a line 186 to the second inlet/outlet 178 of the manual control valve mechanism 170, which in turn is connected with line 172 to the sump 164.

When the control lever 174 is moved in the opposite direction, the control valve mechanism 170 is operable to reverse the flow of hydraulic fluid through the motor 112. In this case, the inlet line 168 is connected with the inlet/outlet 178 so that the fluid under pressure is carried through line 186 to the inlet/outlet 184 of the hydraulic motor 112 to rotate the same in the opposite direction. The fluid exits the hydraulic motor 112 from the inlet/outlet 182 through line 180 and returns to the sump 164 through inlet/outlet 176 of the manual control valve mechanism 170 and the outlet line 172.

When the hydraulic motor 112 is rotated in the first direction, the bolt 108 is turned in the same direction causing the nut 110 to move along the bolt 108 in one direction, as, for example, in a direction away from the hydraulic motor 112. This movement of the nut 110 is transmitted through the mechanism 118 to a movement of the valve stem 160 of the metering valve mechanism 116. The metering valve mechanism 116 is connected with the main pressure line 168 of the hydraulic pump 162 as by a parallel line 188. A line 190 serves to return the hydraulic fluid to the sump 164 when the metering valve mechanism 116 is in its normal or neutral position. When the valve stem or plunger 160 is moved to the right, as viewed in FIG. 9, a first inlet/outlet 192 of the metering valve mechanism 116 is connected with the high pressure line 188 which, in turn, is connected as by line 194 to one side of the piston and cylinder unit 38. The opposite side of the piston and cylinder unit 38 is connected by a line 196 to another inlet/outlet 198 of the metering valve mechanism 116 which allows hydraulic fluid to return to the sump 164 through line 190. FIG. 9 illustrates only one of the hydraulic piston and cylinder units 38, however, it will be understood that parallel lines would be connected with the other hydraulic and cylinder unit at comparable positions.

It can thus be seen that, when the manual control lever 174 is moved into a position to cause the hydraulic motor 112 to rotate in one direction, the nut 110 will be moved to cause the metering valve mechanism 116 to connect the main pressure lines 168 to the piston and cylinder units 38 so as to effect movement of the latter in a direction to effect a pivotal movement between the fixed frame assembly 26 and the movable frame assembly 28 in one direction. For example, this direction would correspond with a counterclockwise movement of the fixed frame assembly 26 with respect to the movable frame assembly 28, as viewed in FIG. 1, or a clockwise movement of the movable frame assembly 28 with respect to the fixed frame assembly 26, as viewed in FIG. 1. The metering valve mechanism 116 is calibrated such that the rate of movement of the hydraulic piston and cylinder units 38 is correlated with the rate of movement of the hydraulic motor 112 and, hence, the linear movement of the nut 110 in response to the rotation of the bolt 108. It will be noted that, as the piston and cylinder unit connected lugs 78 and 80 of the two frame assemblies are moved apart, the connecting lugs 124 and 150 of the rigid structures 104 and 106 of the emergency load-bearing mechanism 102 are also moved apart. As the two emergency load-bearing structures 104 and 106 move apart, the two apertured cross plates 136 and 138 on opposite sides of the nut 110 will move with respect to the bolt 108 generally at the same rate as the nut 110 is moved therealong. Consequently, the relative movement between the frames will continue within the limits provided so long as the control lever 174 is maintained in its actuating position. When the operator sees that an appropriate amount of relative movement has taken place, the lever 174 is moved back into its null position which has the effect of stopping the flow of hydraulic fluid to the motor 112 and hence stopping the turning movement of the bolt 108 so that the motion-transmitting mechanism 118 between the nut 110 and the stem or plunger 160 of the metering valve mechanism 116 becomes a part of the first rigid structure 104 whereas the valve mechanism 116 itself by virtue of its fixed engagement with the mounting plate 158 is a part of the second rigid structure 106. Consequently, as the hydraulic piston and cylinder units 38 continue to move the two frame assemblies apart, relative movement takes place between the valve mechanism 116 and the motion-transmitting mechanism 118 moving the stem 160 of the valve mechanism 116 back into its null position thus cutting off the flow of hydraulic fluid to the position and cylinder units 38. It will be understood that, when the control valve lever is moved in the other direction, similar but opposite functional movements will take place. In this way, the nut 110 is normally disposed out of load-bearing relation with respect to either of the apertured plates 136 and 138. However, in the event of a hydraulic fluid failure in the hydraulic piston and cylinder units 38 which would enable a relative movement between the two frame assemblies 26 and 28 to take place, such relative movement irrespective of which direction would immediately result in the nut engaging one or the other of the plates 136 and 138 which in turn enables the emergency load-bearing rigid structures 104 and 106 to now become actual load-bearing structures between the two frame assemblies. In this way, the emergency load-bearing mechanism 102 normally is retained out of load-bearing relationship with respect to the two frame assemblies but will assume that load-bearing relationship upon hydraulic fluid failure after only a very limited amount of relative movement under the hydraulic failure takes place. It will be noted that, when the emergency load-bearing mechanism 102 does assume the burden of carrying the load, the arrangement is such that no turning movement between the nut and bolt will take place as a result of the imposition of the load therethrough. First, it will be noted that the hydraulic motor 112 is hydraulically isolated from the hydraulic piston and cylinder units 38 by the manual control valve mechanism 170 when the latter is in its null position so that failure of hydraulic pressure to the hydraulic piston and cylinder units 38 would not normally cause the hydraulic motor 112 to be allowed to idle or move. Hence, this system would tend to prevent rotation of the bolt 108. In addition, the pitch of the threaded connection between the bolt 108 and nut 110 is such that turning movement will not be imparted by heavy loads. In this way, the threaded engagement of the nut 110 with the bolt 108 is interlocked against self-turning movement when the emergency load-bearing mechanism 102 assumes the load-bearing relationship.

It thus will be seen that the objects of this invention have been fully and effectively accomplished. It will be realized, however, that the foregoing preferred specific embodiments have been shown and described for the purpose of illustrating the functional and structural principles of this invention and are subject to change without departure from such principles. Therefore, this invention includes all modifications emcompassed within the spirit and scope of the following claims.

What is claimed is:

1. An aerial device—motor vehicle assembly comprising a power-operated tractor vehicle having forward and rearward wheel means and a rear fifth wheel connection, a trailer vehicle including an elongated fixed rearward frame having wheel means supporting the rearward portion thereof, and a movable forward frame, means for connecting said movable frame with the fifth wheel connection of said tractor vehicle for enabling said movable frame to have a turning movement about an upright axis with respect to said tractor vehicle and a tilting movement about a transverse axis with respect to said power operated vehicle, a power-operated extendible and retractible aerial device mounted on said movable frame for swinging movement about an upright axis into a multiplicity of different operative positions including aerial positions imposing severe weight imbalances on said movable frame, means for connecting said movable frame with said fixed frame for pivotal movement about an axis transverse to the longitudinal extent of said fixed frame, power operated means between said movable frame and said fixed frame for effecting relative pivotal movements between said movable and fixed frames and fixedly retaining the same together into different positions of pivotal movement including (1) a transporting position wherein the movable frame constitutes a rigid forward extension of said fixed rearward frame enabling the entire trailer vehicle to turn and tilt with respect to the fifth wheel connection of said tractor vehicle during the power driven movement thereof and (2) an aerial device operating position wherein the movable frame extends horizontally in a longitudinal direction from the fifth wheel connection of the tractor vehicle to the fixed frame in a multiplicty of different positions of longitudinal inclination assumed by said tractor vehicle and said fixed frame by virtue of the longitudinally spaced vertical levels of engagement of the front wheel means of the tractor vehicle with respect to the wheel means of the fixed frame, and normally retracted outrigger means extendible into an operative position of ground engagement to support said movable frame when in said aerial device operating position so as to extend horizontally in a transverse direction in a multiplicity of different positions of transverse inclination assumed by said tractor vehicle and said fixed frame by virtue of the transversely spaced vertical levels of engagement of the front wheel means of said tractor vehicle and the wheel means of said fixed frame.

2. An aerial ladder—motor vehicle assembly as defined in claim 1 wherein said power-operated means comprises piston and cylinder means extendible and retractible by hydraulic fluid under pressure and emergency means mounted between said movable frame and said fixed frame in a normal non-load-bearing relationship operable in response to a loss of hydraulic fluid under pressure from said piston and cylinder means to assume a load-bearing relationship between said movable frame and said fixed frame.

3. An aerial ladder—motor vehicle assembly as defined in claim 2 wherein said emergency means comprises elongated bolt means having a longitudinal axis, means for mounting said bolt means in load bearing relation with respect to one of said structures for rotation of said bolt means about said longitudinal axis, nut means threadedly engaged on said bolt means so as to move (1) in said one direction of extension of said unit in response to the rotation of said bolt means in a first direction and (2) in said opposite direction of retraction of said unit in response to the rotation of said bolt means in a second direction, valve means for controlling the flow of hydraulic fluid under pressure with respect to said hydraulic piston and cylinder means so as to effect extension and retraction thereof, means operatively connected with said bolt means for selectively effecting rotational movement thereof about its longitudinal axis (1) in said first direction to thereby effect movement of said nut means in said one direction and (2) in said second direction to thereby effect movement of said nut means in said opposite direction, means for operatively connecting said nut means to said valve means so that (1) movement of said nut means in said one direction causes said valve means to control the flow of hydraulic fluid under pressure with respect to said unit to effect extension thereof and (2) movement of said nut means in said opposite direction causes said valve means to control the flow of hydraulic fluid under pressure with respect to said unit to effect retraction thereof, emergency load-bearing means, means for mounting a first portion of said load bearing means to the structure other than the one structure with respect to which said bolt means is mounted by the mounting means therefor, means for operatively connecting a second portion of said load bearing means with respect to said nut means in such a way that (1) hydraulic fluid under pressure within said unit retains said load bearing means out of a load bearing relationship with respect to said nut means and said other structure in any position of extension or retraction of said unit, and (2) unwanted loss of hydraulic fluid under pressure from said unit causes said load bearing means to assume a load bearing relationship with respect to said nut means and said other structure substantially in any position of extension or retraction said unit has been moved, the threaded engagement of said nut means with said bolt means being interlocking against self turning movement when said load bearing means assumes said load bearing relationship.

4. An aerial device—motor vehicle assembly as defined in claim 1 wherein the upright and transverse axis of said fifth wheel connection intersect one another and the upright axis of said aerial device is spaced rearwardly from the upright axis of said fifth wheel connection.

5. An aerial device—motor vehicle assembly as defined in claim 4 wherein the mounting of said aerial device includes a turntable structure mounted on said movable frame for rotational movement about the upright swinging axis of said aerial device, said aerial device being pivotally mounted on said turntable for pivotal movement about a transverse axis disposed in intersecting relation to the upright axis of said turntable structure and in rearwardly spaced relation to the transverse axis of said fifth wheel connection, hydraulic power means for effecting the rotational movement of said turntable structure about its upright axis and hydraulic piston and cylinder means for effecting the pivotal movement of said aerial device about its transverse axis.

6. An aerial device—motor vehicle assembly as defined in claim 5 wherein said aerial device includes a power-operated telescopically extendible and retractible ladder assembly.

7. An aerial device—motor vehicle assembly as defined in claim 6 wherein the transverse pivotal axis of said movable frame is disposed in rearwardly spaced relation to the transverse axis of said aerial device and in fixed parallel relation with the transverse axis of said fifth wheel connection.

8. An aerial device—motor vehicle assembly as defined in claim 7 wherein the position of ground engagement of said outrigger means when in said operative position is longitudinally forwardly of the upright and transverse axes of said fifth wheel connection.

9. An aerial device—motor vehicle assembly as defined in claim 8 wherein said outrigger means comprises a pair of outrigger assemblies on transversely opposite sides of said movable frame, each of said outrigger assemblies including horizontal arm means mounted on the associated side of said movable frame for swinging movement about an upright axis between a transport position and an operative position extending transversely outwardly from the associated side of said movable frame, power-operated extendible and retractible leg means fixed to and extending downwardly from the outer end of said horizontal arm means and ground-engaging foot means on the lower end of said leg means.

10. An aerial device—motor vehicle assembly as defined in claim 9 wherein each of said arm means includes a pair of inner and outer hollow arm members mounted in telescopic relation to one another and hydraulic piston and cylinder means within each pair of arm members for telescopically extending and retracting the same.

11. An aerial device—motor vehicle assembly as defined in claim 10 wherein each outrigger assembly includes a hydraulic piston and cylinder unit between the associated inner arm member and the associated side of said movable frame for moving the associated arm means between the transport and operative positions thereof.

12. An aerial device—motor vehicle assembly as defined in claim 11 wherein the wheel means supporting the rearward portion of said trailer vehicle are steerable and a cabin structure for a steering attendant is mounted on the rearward end portion of said fixed frame.

13. An aerial device—motor vehicle assembly as defined in claim 1 wherein said outrigger means comprises a pair of outrigger assemblies on transversely opposite sides of said movable frame, each of said outrigger assemblies including horizontal arm means mounted on the associated side of said movable frame for swinging movement about an upright axis between a transport position and an operative position extending transversely outwardly from the associated side of said movable frame, power-operated extendible and retractible leg means fixed to and extending downwardly from the outer end of said horizontal arm means and ground-engaging foot means on the lower end of said leg means.

14. An aerial device—motor vehicle assembly as defined in claim 13 wherein each of said arm means includes a pair of inner and outer hollow arm members mounted in telescopic relation to one another and hydraulic piston and cylinder means within each pair of arm members for telescopically extending and retracting the same.

15. An aerial device—motor vehicle assembly as defined in claim 14 wherein each outrigger assembly includes a hydraulic piston and cylinder unit between the associated inner arm member and the associated side of said movable frame for moving the associated arm means between the transport and operative positions thereof.

16. An aerial device—motor vehicle assembly as defined in claim 1 wherein the wheel means supporting the rearward portion of said trailer vehicle are steerable and a cabin structure for a steering attendant is mounted on the rearward end portion of said fixed frame.

17. An aerial device—motor vehicle assembly as defined in claim 1 wherein the position of ground engagement of said outrigger means when in said operative position is longitudinally forwardly of the upright and transverse axes of said fifth wheel connection.

18. Apparatus for moving a heavily loaded structure with respect to another structure comprising piston and cylinder means extensible and retractible by hydraulic fluid under pressure, means for mounting said piston and cylinder means with respect to said structures such that (1) extension of the piston and cylinder means causes the heavily loaded structure to move in one direction and (2) retraction of the piston and cylinder means causes the heavily loaded structure to move in an opposite direction, and emergency means mounted between said structures in a normal non load-bearing relationship operable in response to an unwanted loss of hydraulic fluid under pressure from said piston and cylinder means to assume a load-bearing relationship between said movable and fixed frames, said emergency means including elongated bolt means having a longitudinal axis, means for mounting said bolt means in load bearing relation with respect to one of said structures for rotation of said bolt means about said longitudinal axis, nut means threadedly engaged on said bolt means so as to move (1) in said one direction of extension of said piston and cylinder means in response to the rotation of said bolt means in a first direction and (2) in said opposite direction of retraction of said piston and cylinder means in response to the rotation of said bolt means in a second direction, valve means for controlling the flow of hydraulic fluid under pressure with respect to said piston and cylinder means so as to effect extension and retraction thereof, means operatively connected with said bolt means for selectively effecting rotational movement thereof about its longitudinal axis (1) in said first direction to thereby effect movement of said nut means in said one direction and (2) in said second direction to thereby effect movement of said nut means in said opposite direction, means for operatively connecting said nut means to said valve means so that (1) movement of said nut means in said one direction causes said valve means to control the flow of hydraulic fluid under pressure with respect to said piston and cylinder means to effect extension thereof and (2) movement of said nut means in said opposite direction causes said valve means to control the flow of hydraulic fluid under pressure with respect to said piston and cylinder means to effect retraction thereof, load-bearing means having first and second portions, means for mounting said first portion of said load bearing means to the structure other than the one structure with respect to which said bolt means is mounted by the mounting means therefor, means for operatively connecting said second portion of said load bearing means with respect to said nut means is such a way that (1) hydraulic fluid under pressure within said piston and cylinder means retains said load bearing means out of a load bearing relationship with respect to said nut means and said other structure in any position of extension or retraction of said piston and cylinder means, and (2) unwanted loss of hydraulic fluid under pressure from said piston and cylinder means causes said load bearing means to assume a load bearing relationship with respect to said nut means and said other structure substantially in any position of extension or retraction said piston and cylinder means has been moved, the threaded engagement of said nut means with said bolt means being interlocking against self turning movement when said load bearing means assumes said load bearing relationship.

19. Apparatus as defined in claim 18 wherein said bolt means comprises an elongated bolt, said nut means comprising a nut threadedly mounted on said bolt, said bolt rotating means comprising a reversible hydraulic motor and a manual control valve normally disposed in a null position for preventing flow of hydraulic fluid through said reversible hydraulic motor in either direction, said manual control valve being manually movable from said null position into (1) a first position causing hydraulic fluid under pressure to flow through said hydraulic motor in a first direction to cause said hydraulic motor to move in a first direction and (2) a first position causing hydraulic fluid under pressure to flow through said hydraulic motor in the opposite direction to cause said hydraulic motor to move in a second direction and means for connecting said hydraulic motor to said bolt so that (1) movement of said hydraulic motor in said first direction rotates said bolt in said first direction and (2) movement of said hydraulic motor in said second direction rotates said bolt in said second direction.

20. Apparatus as defined in claim 19 wherein said manual control valve and said valve means are connected in parallel with the same hydraulic pump.

21. Apparatus as defined in claim 19 wherein said bolt mounting means comprises a first load-bearing rigid structure having one end pivotally mounted to said movable frame, said hydraulic motor being fixedly mounted on said first structure and means including a double-acting thrust bearing for rotatably mounting said bolt on said first rigid structure.

22. Apparatus as defined in claim 21 wherein said load-bearing means includes a second rigid structure elongated so as to provide said first portion at one end thereof which is pivotally connected with said fixed frame and said second portion at an opposite end thereof, said second portion connecting means comprising a pair of plates having apertures of a size to receive said bolt therethrough with clearance, said plates being rigidly fixed to the second portion of said second rigid structure and disposed in closely spaced relation on opposite sides of said nut with said bolt extending through the apertures thereof.

* * * * *